US006978516B1

(12) United States Patent
Calderon et al.

(10) Patent No.: US 6,978,516 B1
(45) Date of Patent: Dec. 27, 2005

(54) APPARATUS FOR CONTROLLING VARIOUS MOVEMENTS OF A DOOR

(75) Inventors: Fernando Calderon, Granada Hills, CA (US); Duane Beswick, Bradley, CA (US); Greg Pastor, Studio City, CA (US)

(73) Assignee: Commercial Display Systems, LLC, San Fernando, CA (US)

( * ) Notice: Subject to any disclaimer, the term of this patent is extended or adjusted under 35 U.S.C. 154(b) by 0 days.

(21) Appl. No.: 10/452,242

(22) Filed: Jun. 2, 2003

(51) Int. Cl.[7] ..... E05D 7/04

(52) U.S. Cl. ..... 16/235; 16/240; 16/245; 16/229; 16/301; 16/308; 16/361

(58) Field of Search ..... 16/229, 230, 231, 16/262, 263, 268, 240, 245, 246, 105, 32, 16/301, 308, 378, 302, 50, 54, 55, 331, 332, 16/334, 361, 70, 65; 49/315–317, 321, 325–327, 49/381, 394, 397, 395, 502, 505; 52/126.1; 160/206, 198, 199, 118, 129; 292/262, 338, 292/228, 341.16, DIG. 15, DIG. 17

(56) References Cited

U.S. PATENT DOCUMENTS 262,005 A * 8/1882 Clark et al. ..... 16/70
317,147 A * 5/1885 Krumscheid ..... 16/70
998,692 A 7/1911 Keene et al.
1,334,563 A 3/1920 Shelton
1,766,011 A * 6/1930 Byrd ..... 16/65
3,251,088 A * 5/1966 Boundy ..... 16/242
3,285,324 A * 11/1966 Stein et al. ..... 160/206
3,339,225 A 9/1967 Booth
3,365,747 A * 1/1968 Barroero ..... 16/308
3,507,074 A 4/1970 Gallegos
3,662,429 A * 5/1972 Johnson et al. ..... 16/357
3,683,453 A * 8/1972 McLeland et al. ..... 16/248
3,702,491 A 11/1972 Pelletiere
3,866,658 A * 2/1975 Smith ..... 160/206
3,867,790 A * 2/1975 Frank ..... 49/381
3,932,913 A * 1/1976 Johnson ..... 16/245
4,064,590 A * 12/1977 Smith ..... 16/90
4,106,876 A * 8/1978 Tregoning ..... 403/4
4,547,929 A * 10/1985 Lew et al. ..... 16/286
4,692,963 A 9/1987 Barroero
4,696,078 A * 9/1987 Stromquist ..... 16/301
4,800,678 A * 1/1989 Loos ..... 49/394
4,905,347 A * 3/1990 Wroth ..... 16/308
4,953,259 A * 9/1990 Frye et al. ..... 16/225
5,050,270 A * 9/1991 Burgei et al. ..... 16/298
5,321,870 A * 6/1994 Wada et al. ..... 16/300
5,333,355 A 8/1994 Beswick et al.
5,490,305 A * 2/1996 Domingo Ribot ..... 16/229
5,495,639 A * 3/1996 Wartian ..... 16/79
5,568,673 A * 10/1996 Ryczek ..... 16/244
5,571,493 A * 11/1996 Fulmer et al. ..... 423/308
5,606,773 A * 3/1997 Shappell ..... 16/298
6,176,040 B1 * 1/2001 Sugihara ..... 49/394
6,205,616 B1 * 3/2001 Hwang ..... 16/229

* cited by examiner

*Primary Examiner*—Chuck Mah
(74) *Attorney, Agent, or Firm*—John Joseph Hall

(57) ABSTRACT

Apparatus for controlling various and different movements of a door, said apparatus having a door hinge assembly with a hinge pin having a plurality of bearing surfaces to reduce stress and wear on a hinge pin housing, a torque mechanism for pre-torquing and torquing a hinged door, a door leveling mechanism that operates at the top of the door while the door remains closed, and a semi-automated mechanism that holds the door 90 degrees open and releases the door for closing by said torque mechanism.

17 Claims, 8 Drawing Sheets

FIG. 3
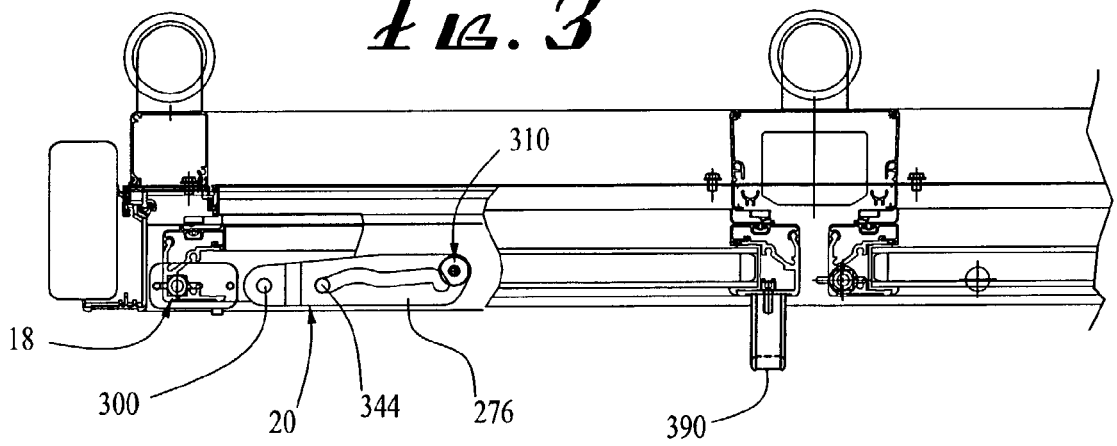
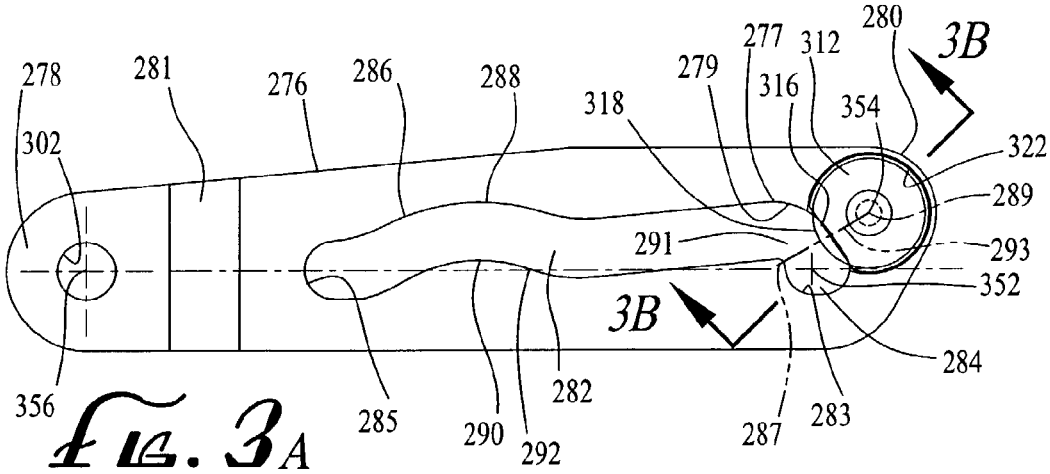
FIG. 3A
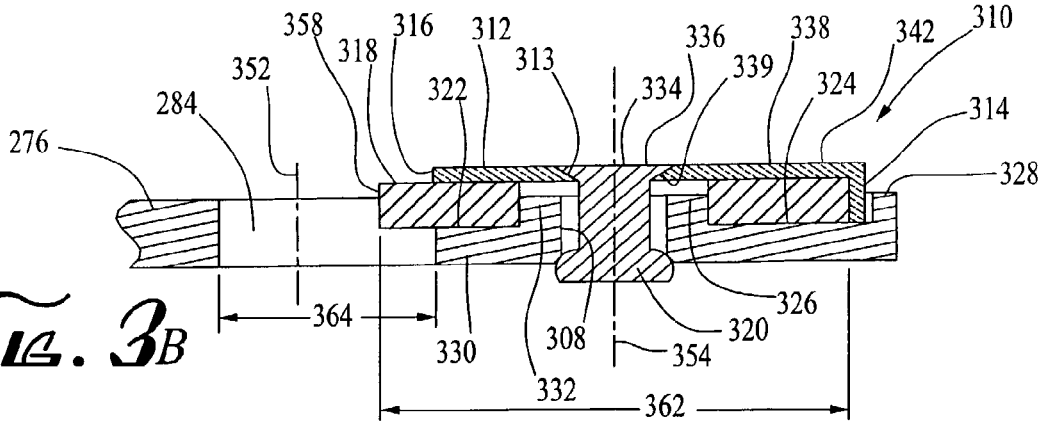
FIG. 3B

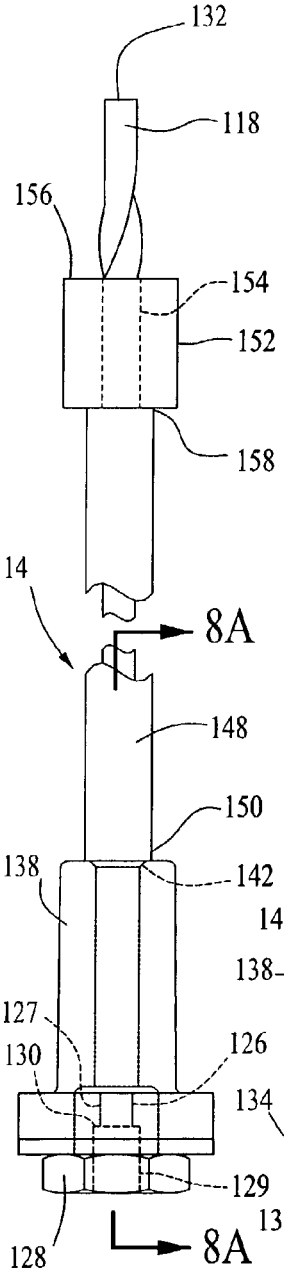
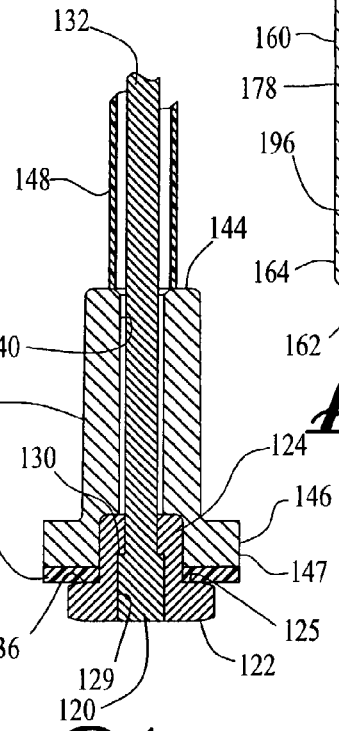
FIG. 8 FIG. 8A
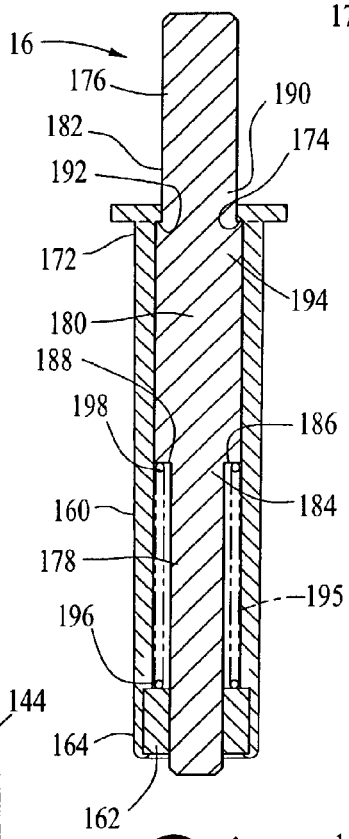
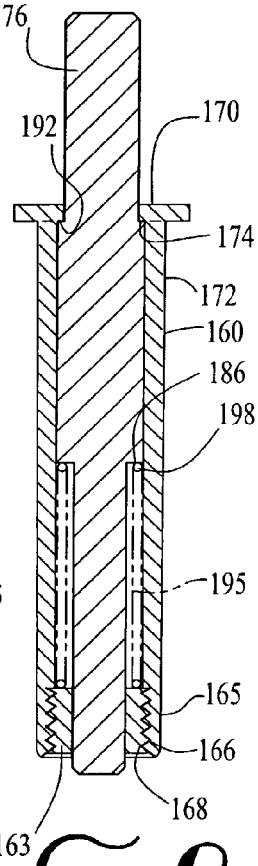
FIG. 9 FIG. 9A

APPARATUS FOR CONTROLLING VARIOUS MOVEMENTS OF A DOOR

BACKGROUND OF THE INVENTION

1. Field of the Invention

This invention relates to apparatus for controlling various and different movements of a door by means of a torque mechanism for torquing a door hinge assembly, by means of a unique door leveling mechanism, and by means of a novel semi-automated mechanism that provides a 90 degree held open door and release of the 90 degree held open door.

2. Description of the Prior Art

Prior art devices for movement of a door by providing torqued hinges for doors within a frame often have component parts for torquing the door hinge that are subject to excessive stress and wear, thereby resulting in failure of the component parts. Further, applicants are unaware of any prior art providing for an adjustable door leveling means that operates on a door from the top of the door's frame or from the top of an opening in a structure closed by a door without a frame, and levels a door that is not properly leveled due to improper installation of the door in its frame or in the opening of a structure without requiring opening of the door. Nor does the prior art disclose any means to hold a door open 90 degrees by an a semi-automated mechanism together with a semi-automated release of the door held open 90 degrees.

OBJECTS OF THE INVENTION

It is, therefore, an object of the invention to provide apparatus including a door hinge assembly that can be torqued using component parts that avoid excessive stress and wear so that early failure of the parts is avoided.

2. Another object of the invention is to provide an apparatus having door leveling means for a door which is not installed level that operates on a door from the top of the door's frame or from the top of an opening in a structure closed by a door without a frame and without having to open the door to level it.

3. A further object of the invention is to provide a semi-automated mechanism that holds a door open 90 degrees and also provides immediate semi-automated release of the 90 degree held open door.

4. A still further object of the invention is to provide a torque mechanism having a gear member that produces the desired torque on a door by a tooth by tooth action.

BRIEF DESCRIPTION OF THE DRAWINGS

FIG. 3 is a horizontal cross section of the door and frame with a cutaway portion showing part of the torqued hinge assembly and the combined door holding open and release mechanism.

FIGS. 3A and 3B show details of the construction of the activated semi-automated door holding and release mechanism.

FIG. 4A shows the door open to 90 degrees. FIG. 4B shows the door open halfway. FIG. 4C shows the door closed.

FIG. 8 shows an elevational view of the torque rod assembly.

FIG. 8A shows a cross section of the base of the torque rod assembly.

FIG. 9 is a cross section of the upper portion of the hinge pin of the torqued door hinge assembly showing the plug member coined in the bottom of the inner end of the hinge pin housing.

FIG. 9A is a cross section showing another embodiment of the upper portion of the hinge pin of the torqued door hinge assembly with the outer circumference of the plug member formed with threads and threaded into the threaded bottom of the inner end of the hinge pin housing.

DETAILED DESCRIPTION OF PREFERRED EMBODIMENTS

Figure 1:
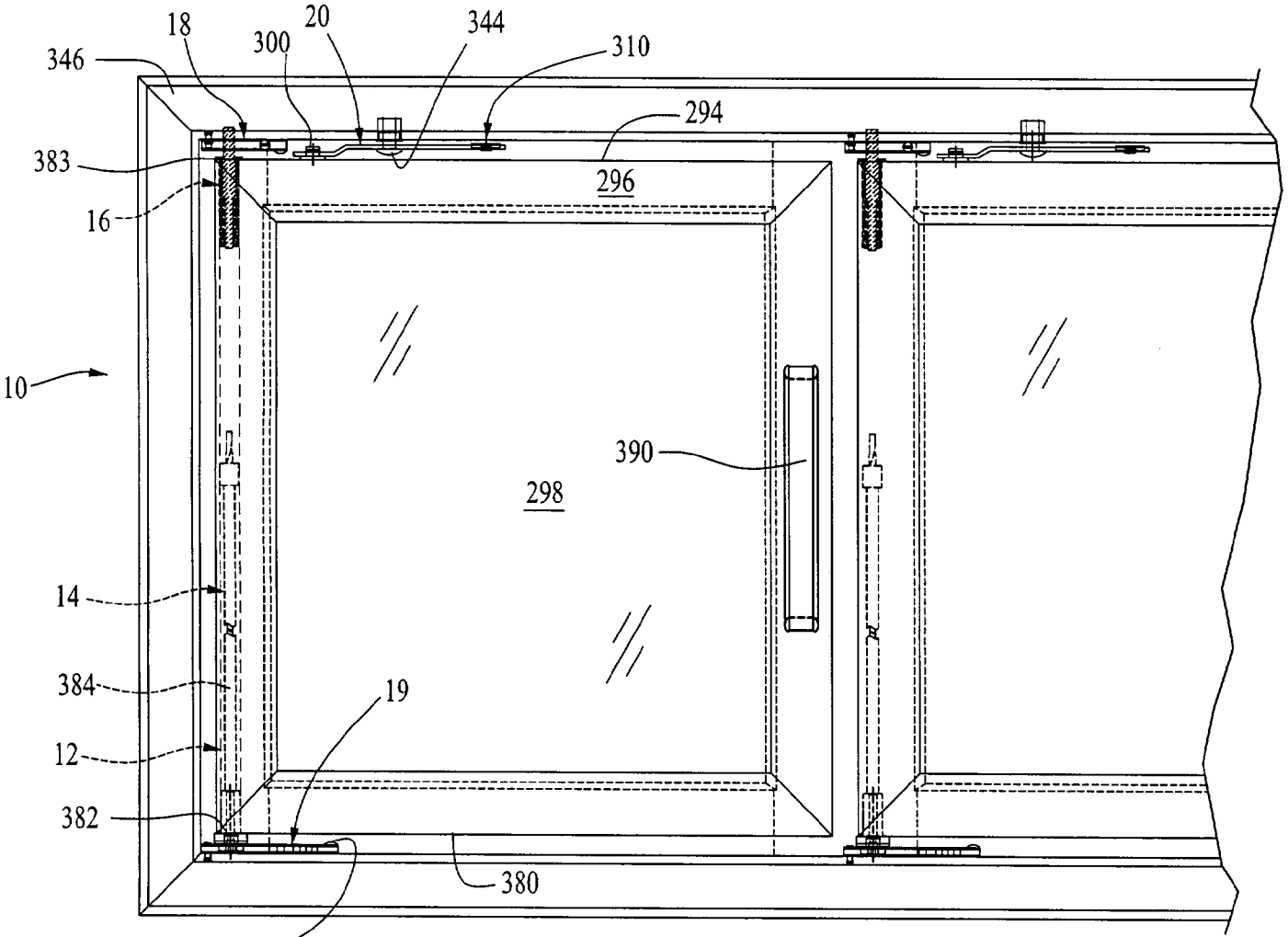
FIG. 1 is a front elevational view of a door inserted in a frame and with the invention installed therein.
Figure 2:
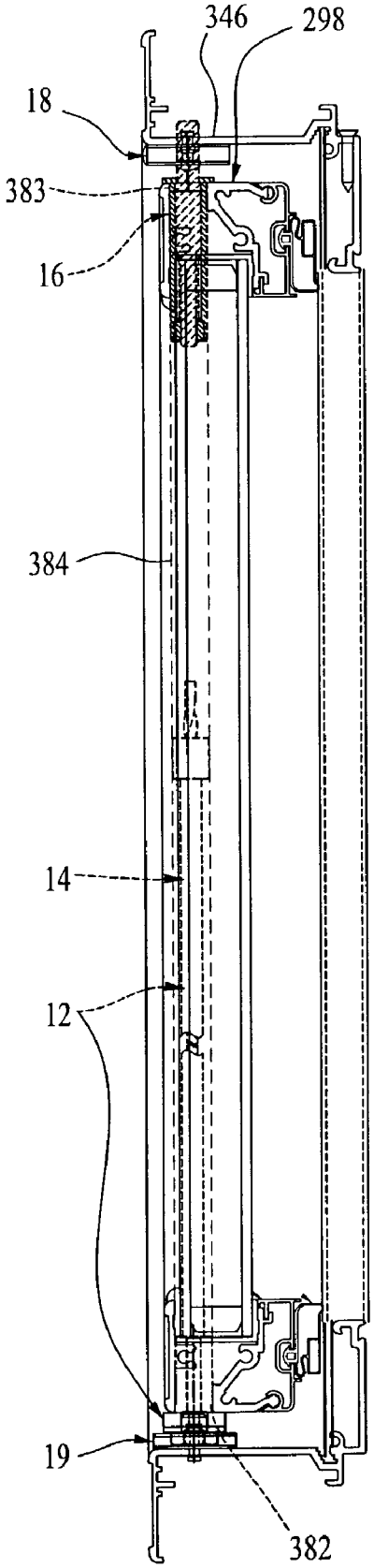
FIG. 2 is a vertical cross section of the door and frame with the invention installed therein.

The invention comprises an apparatus 10 for controlling various movements of a door which is made up of several subassemblies, namely, a torque mechanism 12 comprising a torque rod assembly 14 and a torque housing assembly 19, a hinge pin assembly 16, a door leveling assembly 18, and a semi-automatic mechanism 20 for holding a door open 90 degrees and then releasing it.

Torque Mechanism 12

The torque mechanism 12 has a torque housing assembly 19 including torque housing spacer 22 in the preferred shape of a flat rectangular thin plate preferably about ⅛ inch in thickness with several cut out, or if made with a mold, several hollowed out portions or segments. Torque housing spacer 22 is preferably made of steel, aluminum, zinc, or plastic material.

Figure 7B:
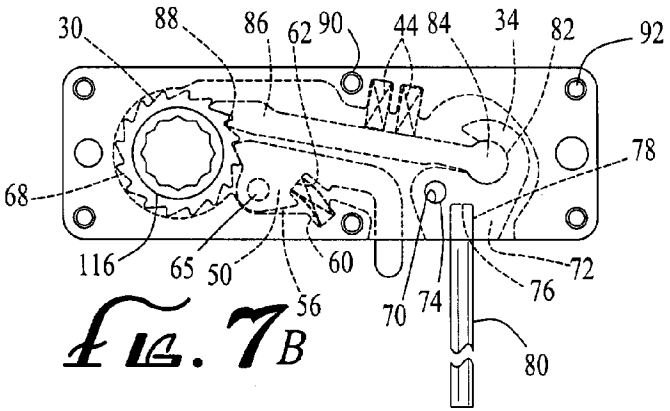
FIGS. 7A through 7E show details of the torque mechanism of the torqued door hinge assembly.
Figure 7E:
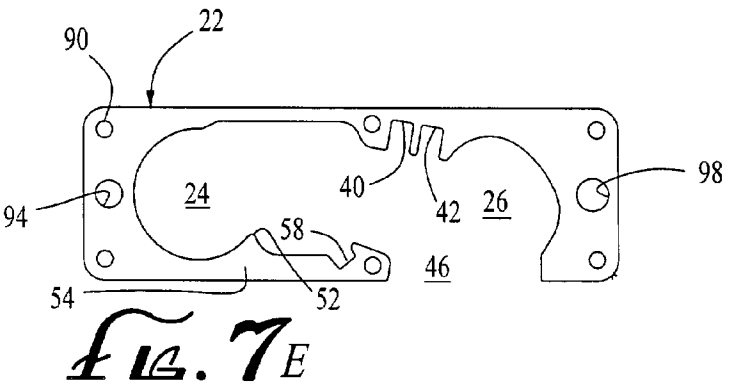
Figure 7A:
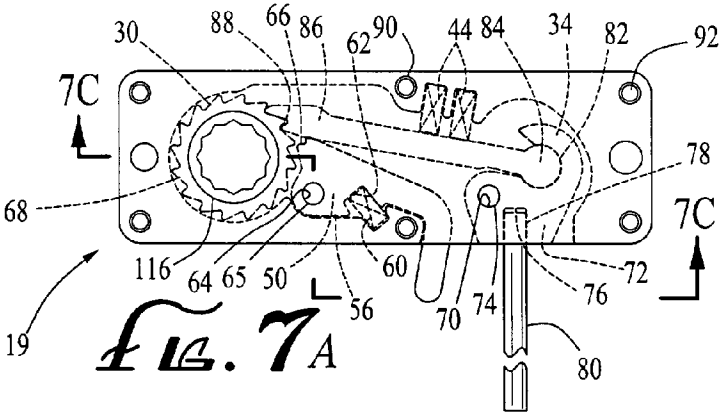
Figure 7C:
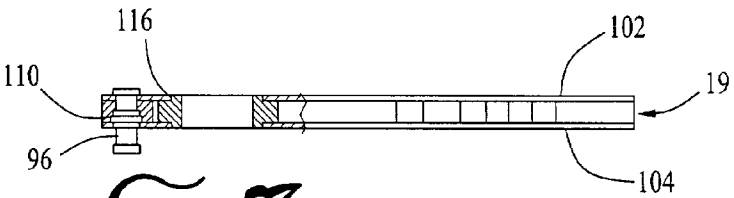
Figure 7D:
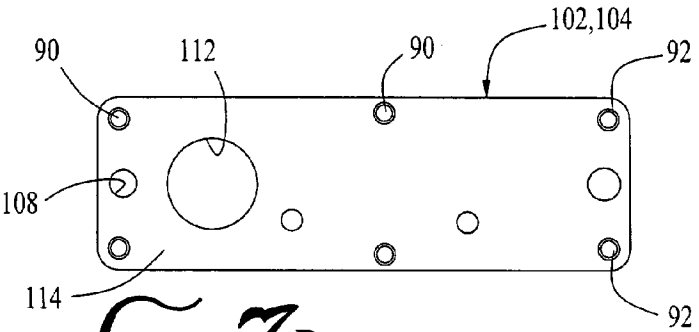

Portion 24 is located at the left side of torque housing spacer 22 and has a semi-circular form as shown in FIG. 7E and is shaped to accommodate a circular toothed gear 30 shown in FIG. 7A. Portion 26 has a similar but less of a semi-circular form than portion 24 and is located at the right side of torque housing spacer 22.

Portion 26 is shaped to accommodate torque cam 34. At the top of torque housing spacer 22 and between portions 24 and 26 are two rectangular cavities 40 and 42 cut out or hollowed out of torque housing spacer 22 and formed into a size capable of receiving springs 44 as shown in FIG. 7A.

The bottom of torque housing spacer 22 has an opening 46 located adjacent to the lower inner end of portion 26 as shown in FIG. 7E and is sufficiently wide to permit insertion of torque cam 34 and pawl arm 50 as shown in FIG. 7A. The top surface 52 of the bottom 54 of torque housing spacer 22 adjacent to portion 46 is shaped to be congruent with the bottom surface 56 of the bottom of pawl arm 50 and has a rectangular cavity 58 cut at an angle that permits insertion of pawl arm spring 60. Pawl arm 50 has a rectangular cavity 62 cut at an angle that permits insertion of the top portion of pawl arm spring 60 as shown in FIG. 7A. Cavity 58 and cavity 62 are in alignment.

The inner portion of pawl arm 50 has circular opening 64 to receive pawl pivot pin 65 as shown in FIG. 7A. The inner pawl surface 66 of pawl arm 50 is shaped to interface with the teeth 68 of torque gear 30.

Torque cam 34 has a circular opening 70 in the left side of bottom portion 72 to receive cam pivot pin 74. The bottom portion 72 of torque cam 34 has a cut out cavity 76 of a size and shape suitable to receive the outer end 78 of torque tool 80. The upper portion 82 of torque cam 34 is semi-circular in form to receive the outer end 84 of gear actuating lever 86. The inner end 88 of gear actuating lever 86 is formed to interlock with the teeth 68 of torque gear 30.

Each corner of torque housing spacer 22 has a circular opening 90 to receive holding rivets 92. The middle portion of the top and bottom of torque housing spacer 22 each have a circular opening 90 to receive rivets 92. The middle portion of the left end of torque housing spacer 22 has a circular opening 94 to receive a floating lock pin 96 and the middle portion of the right end of torque housing spacer 22 has a circular opening 98 to receive an installation screw 100.

The torque housing spacer 22 is covered by a top cover 102 and a bottom cover 104 which are part of torque housing 19. Both covers 102 and 104 have circular openings 90 at each corner and at the middle portion of their respective tops and bottoms that are congruent with the openings 90 of torque housing spacer 22 and receive rivets 92 to hold various component parts that are included in torque housing 19.

Top cover 102 and bottom cover 104 each have same size circular openings 108 at their left ends but slightly smaller than the circular opening 94 of torque housing spacer 22 and small enough to prevent floating locking pin 96 when inserted in torque housing spacer 22 from falling out. Floating locking pin 96 has a central portion 110 which has a circumference greater than the circumference of openings 108 but smaller than the circumference of opening 94 so that it may move up and down inside the torque housing 19.

The top cover 102 and bottom cover 104 each have a relatively large circular opening 112 of equal size at the left portion 114 of each to accommodate a circumferential shoulder 116 on each side of torque gear 30 to keep torque gear 30 in position.

Torque rod assembly 14 has a torque rod 118 made of preferably ⅛ inch square steel wire and is cut at its lower end 120. Lower end 120 is pinched or coined to make it larger so it will be securely fixed in position at the time of assembly of torque rod assembly 14. A preferable length of torque rod 118 is about 30 inches. The size, weight, gauge, shape, and length of torque rod 118 may vary to accommodate a particular application so long as some flexibility is maintained.

Cylindrical torque nut 122 has a top portion 124 with a reduced outer circumference forming shoulder 125 and has a square opening 126 leading to square bore 127. Its lower portion 128 has its outer circumference formed in a hexagonal shape. The cylindrical lower bore 129 is formed with a cylindrical interior shoulder 130 to help secure the coined or enlarged portion of lower end 120 of torque rod 118 when lower end 120 is placed in position in torque rod nut 122. Torque rod nut 122 is slipped over the top end 132 of torque rod 118 and slid down the torque rod 118 to its lower end 120 so that the coined or enlarged portion of lower end 120 of torque rod 118 is contained in cylindrical bore 129 of torque nut 122.

Torque rod washer 134, preferably made of nylon or other similar suitable material that resists wear, is then slipped over the top end 132 of torque rod 118 and slid down torque rod 118 to seat on the top surface 136 of shoulder 125 of torque nut 122.

Torque rod bushing 138 is then installed by slipping it over top end 132 of torque rod 118 and sliding it down torque rod 118 to seat on top of torque rod washer 134. The torque rod bushing 138 has a bore 140 with a diameter of a size sufficient to accommodate torque rod 118 and is formed with an interior shoulder 142 at its top 144 and is tapered slightly with an increasing outer circumference toward its base 146 to allow easy insertion in a door and a press fit of base 146 at the bottom of a door. A preferable taper amount is about ½ degree and may vary from $^{442}/_{1000}$ to $^{458}/_{1000}$ of an inch. Base 146 of torque rod bushing 138 is formed with a cylindrical outer flange 147 that seats on torque rod washer 134.

Torque rod tubing 148 of a suitable length is then slipped over the top end 132 of torque rod 118 and is slid down torque rod 118 to abut its lower end 150 against the top surface of shoulder 142, thereby creating a bearing surface on the top of bushing 138 as shown in FIGS. 8 and 8A.

Torque rod block 152, having a square center bore 154, is then slipped over the top end 132 of torque rod 118 and slid down to seat its bottom on the top end 158 of torque rod tubing 148 so that the top 156 of torque rod block 152 is near the top end 132 of torque rod 118.

All of the foregoing components of torque rod assembly 14 are held firmly and the top end 132 of torque rod 118 is twisted one quarter of a turn, preferably, thereby securing all component parts of torque rod assembly 14 in place, particularly the portion of the lower end 120 of torque rod 118 that is coined or enlarged and has been inserted into square opening 126 and bore 127 of torque nut 122. The turn of top end 132 may be varied in amount by plus or minus ⅛ inch, turning clockwise or counterclockwise.

Hinge Pin Assembly 16

Hinge pin assembly 16 has a cylindrical hinge pin housing 160 with a cylindrical plug 162 coined in the lower end 164 of hinge pin housing 160 in one embodiment as shown in FIG. 9, and in another embodiment, cylindrical plug 163 as shown in FIG. 9A, formed with threads 166 in its outer circumference that are threaded into threads 168 formed inside the lower end 165 of hinge pin housing 160. Hinge pin housing 160 has a circular flange 170 formed at its top end 172 extending around the outer circumference of hinge pin housing 160 and around the inner circumference of hinge pin housing 160 to form an inside shoulder or edge 174, as shown in FIGS. 9 and 9A.

The hinge pin housing 160 is preferably made of aluminum but any suitable metal may be used having qualities similar to aluminum. It is formed with a slight taper which increases the size of its outer circumference as it progresses toward its top end 172 to provide a press fit at the top of a door in conjunction with flange 170.

Hinge pin 176 is formed in one rigid piece with an elongated inner shank portion 178 having a reduced circumference, an elongated middle body portion 180, and an elongated outer shank portion 182 which has a circumference larger than the circumference of the elongated inner shank portion 178 but smaller than the circumference of elongated middle body portion 180 as shown in FIGS. 9 and 9A. Hinge pin 176 is preferably made of tough stainless steel, although other materials may be used having qualities similar to stainless steel.

Top end 184 of elongated inner shank portion 178 produces a shoulder 186 in conjunction with the bottom end 188 of elongated middle body portion 180.

The bottom end 190 of elongated outer shank portion 182 produces a shoulder 192 in conjunction with the top end 194 of elongated middle body portion 180 which abuts against the inside shoulder or edge 174 of hinge pin housing 160 as shown in FIG. 9 and FIG. 9A. The elongated inner shank portion 178 of hinge pin 176 extends out of plug 162. The elongated outer shank portion 182 of hinge pin 176 extends out of the top end 172 of hinge pin housing 160.

Hinge pin 176 has three bearing surfaces, elongated inner shank portion 178, elongated middle body portion 180, and elongated outer shank portion 182, which distribute the load on hinge pin housing 160, thereby reducing stress on hinge pin housing 160 and preventing a short life and premature failure of hinge pin housing 160. The load on hinge pin housing 160 comes from the weight of the door on which it is being used and the movement of the door.

Cylindrical hinge pin spring 195 is placed around hinge pin 176 with its bottom 196 abutting against the top surface of plug 162 and retained there, and with its top 198 abutting against shoulder 186, thereby spring loading the hinge pin assembly 16 as shown in FIG. 9 and FIG. 9A.

The hinge pin assembly 16 is assembled by first inserting hinge pin 176 into hinge pin housing 160, next placing hinge pin spring 195 around elongated inner shank portion 178 and positioning spring top 198 against shoulder 186, and then inserting plug 163 either by threading it or coining plug 162 at the lower end 164 of hinge pin housing 160.

Figure 6A:
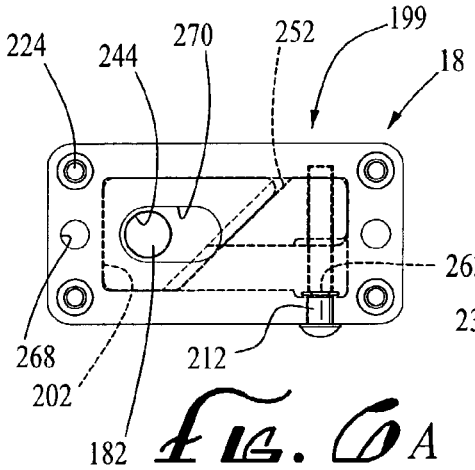
FIGS. 6A through 6G show details of the door leveling assembly.
Figure 6B:
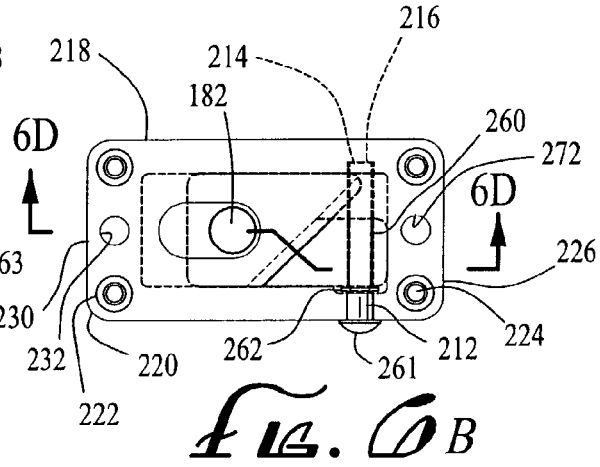

Door leveling assembly 18 has a leveling housing 199 that includes leveling housing spacer 200 in a preferred shape of a flat rectangular thin plate preferably about 3/16 inch in thickness and with a cut out rectangular portion 202 in its center that is sufficient in size to allow movement of slide plate 204 and adjustment plate 206 as shown in FIGS. 6A and 6B. Leveling housing spacer 200 has a bottom 208 and a top 201 may be made of steel, aluminum, zinc or plastic. Slide plate 204 and adjustment plate 206 may be made of steel, brass, zinc, or aluminum. The right portion of right side wall of leveling housing spacer 200 has a circular opening 210 to accommodate adjustment screw 212 as shown in FIGS. 6A, 6B and 6C and 6G. The top end 214 of adjustment screw 212 extends into a recess 216 formed in the inner surface of the right portion of left side wall 218 of leveling housing spacer 200 as shown in FIGS. 6A and 6B.

Each corner 220 of leveling housing spacer 200 has a circular opening 222 of the same size to receive rivets 224. The center of the right side 226 of leveling housing spacer 200 has a circular opening 272 to accommodate an installation screw 228. The center of the left side 230 of leveling housing spacer 200 has a circular opening 232 to accommodate floating locking pin 234.

Figure 6C:
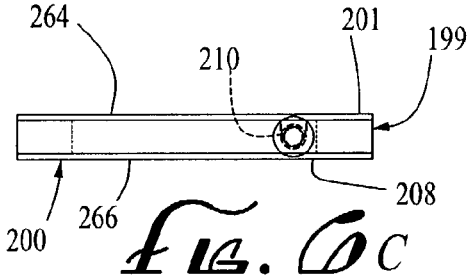
Figure 6D:
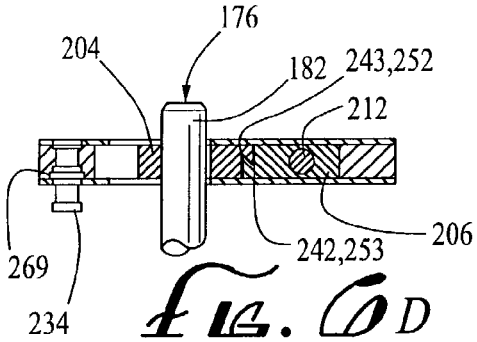
Figure 6E:
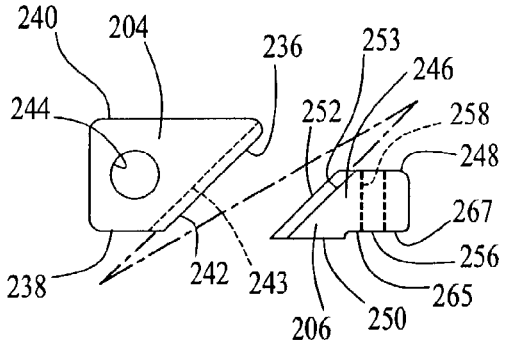
Figure 6F:
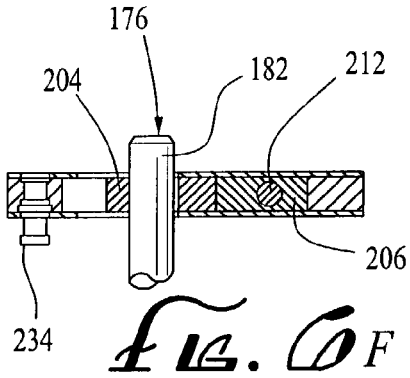
Figure 6G:
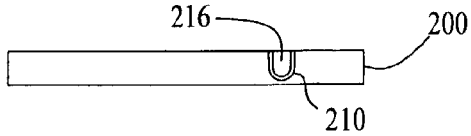

Leveling housing 199 includes a slide plate 204 formed from a rectangular plate that has its right side 236 cut out at an angle, preferably 45 degrees, from the bottom 238 of slide plate 204, so as to render its bottom 238 shorter than its top 240 as shown in FIG. 6E, and to produce a longitudinal projection or tongue 242 and groove 243 along cut out right side 236. Slide plate 204 has a circular opening 244 cut in its left portion to accommodate the outer shank portion 182 of hinge pin 176.

Leveling housing 199 includes adjustment plate 206 formed from a rectangular plate smaller than the rectangular plate of slide plate 204 but having the same thickness as slide plate 204 with its left side 246 cut out at an angle, preferably 45 degrees, so as to render its top 248 shorter than its bottom 250 and to produce a longitudinal projection or tongue 252 and groove 253 which receive projection or tongue 242 and groove 243 of slide plate 204, thereby creating a double interlocking condition of slide plate 204 and adjustment plate 206 in a constraining condition in an angled interface. Any other suitable means may be used to interlock slide plate 204 and adjustment plate 206 such as a dovetail.

The size of adjustment plate 206 is preferably about one/half of the size of slide plate 204 but any other ratio of sizes may be used such as 60/40 so long as the desired result is obtained. Further, the 45 degree angle of the right side of slide plate 204 and the 45 degree angle of the left side of adjustment plate 206 may be varied so long as the desired result is obtained, an angled interface.

Bottom side wall 250 of adjustment plate 206 has a circular opening 256 in its right portion for receiving adjustment screw 212. Adjustment plate 206 has a threaded bore 258 which permits threading with the threads 260 of adjustment screw 212 as shown in FIGS. 6A, 6B, and 6C.

Adjustment screw 212 has a head 261 which has a greater circumference than its threads 260 and may be slotted or have a Phillips type head. Adjustment screw 212 is formed with a flange 262 located around its middle section which prevents adjustment screw 212 from falling out of leveling housing 199 since flange 262 has a greater circumference than the circular opening 210 at the right side wall of leveling housing spacer 200. The top 263 of flange 262 is no higher than the top 201 of leveling housing spacer 200 and is preferably in alignment with top 201. The bottom right edge 265 of adjustment plate 206 has a slight indentation 267 to prevent possible interference with flange 262 of adjustment screw 212. However, indentation 267, although it improves performance, may be omitted without causing serious adverse effects on the operation of adjustment plate 206.

The top end 214 of adjustment screw 212 is blunt in form (not shown) and has a circumference smaller than the threaded portions of adjustment screw 212. The insertion of top end 214 into recess 216 increases the stability of adjustment screw 212 as it is being turned.

When adjustment plate 206 is interlocked with slide plate 204, for a door hinged on its right side, clockwise turning of adjustment screw 212 moves adjustment plate 206 towards the front of leveling housing spacer 200, which causes slide plate 204 to move to the right. Counterclockwise turning of adjustment screw 212 moves adjustment plate 206 towards the back of leveling housing spacer 200, which causes slide plate 204 to move to the left.

When adjustment plate 206 is interlocked with slide plate 204, for a door hinged on its left side, counterclockwise turning of adjustment screw 212 moves adjustment plate 206 towards the front of leveling housing spacer 200, which causes slide plate 204 to move to the right. Clockwise turning of adjustment screw 212 moves adjustment plate 206 towards the back of leveling housing spacer 200, which causes slide plate 204 to move to the left.

The slide plate 204 and adjustment plate 206 may both be modified by forming them without a tongue and groove, and will still work to cause adjustment of a door. However, the tongue and groove embodiments of the slide plate 204 and adjustment plate 206 are preferred embodiments.

When the adjustment plate 206, formed without a tongue and groove, moves in a back to front direction, forces applied against the angle in the adjustment plate which pushes against the slide plate 204, which also does not have a tongue and groove, causes the slide plate 204 to move in a sideways motion when the adjustment screw 212 is turned in one direction.

When the adjustment screw 212 is turned in the opposite direction, the adjustment plate 206 moves in a front to back direction because the forces relieved in adjustment plate 206 allows the slide plate 204 to move by the weight of the door.

The orientation of both slide plate 204 and adjustment plate 206 may be modified by turning each over so that their respective back sides are facing up while both are in their original location.

The top 210 of leveling housing spacer 200 is covered by a top cover 264 and its bottom 208 with a bottom cover 266. Both covers 264 and 266 have circular openings 222 at each corner to receive rivets 224 and are of the same size as the circular openings 222 of leveling housing spacer 200 and are congruent with the circular openings 222 of leveling housing spacer 200.

The middle portion of the left side of both covers 264 and 266 have circular openings 268 of the same size as each other but slightly larger than the circular opening 232 of leveling housing spacer 200 and small enough to prevent floating locking pin 234 when inserted in door leveling assembly 18 from falling out.

Floating locking pin 234 has a central portion 269 which has a circumference greater than the circumference of openings 268 but smaller than the circular opening 232 so that it may move up and down inside leveling housing 199 without falling out of leveling housing 199.

Top cover plate 264 and bottom cover plate 266 each have the same size slot 270 cut in their left portions and are congruent with each other.

Slot 270 is also located within the open area of rectangular portion 202 of leveling housing spacer 200 and is large enough to accommodate the outer shank portion 182 of hinge pin 176. The middle portion of the right sides of leveling housing spacer 200, top cover plate 264, and bottom cover plate 266 each have the same size circular opening 272 to receive installation screw 274.

When top cover plate 264 and bottom cover plate 266 are placed in position with leveling housing spacer 200 in between, top cover plate 264 and bottom cover plate 266 maintain adjustment screw 212 within leveling housing 199 due to the shoulder 262 of adjustment screw 212. The door leveling assembly 18 has the capability of moving a door hinge in a left or right direction up to ⅛ inch from center to allow a door installed in an out of square or level position in its frame to be properly squared in its frame, which accounts for the great majority of doors out of square or not completely level with its frame.

Further, the foregoing construction and arrangement of component parts accomplishes the leveling process at the top of the out of square door instead of at the bottom, which greatly facilitates and decreases the amount of time and the amount of work required for the leveling process.

A door which is more than ¼ inch out of square or level is an unusual situation which either requires the door to be removed and replaced in its frame or which requires the removal of the frame and door together and then to be reinstalled due to improper initial installation.

The door leveling assembly 18 may be easily adapted for use in an application where the door in question does not have a separate frame but closes an opening in any structure having a top, a bottom, and two sides.

The semi-automated door held open and release mechanism 20 (door held open and release mechanism 20) has a door hold open arm 276 formed with a semi-circular left end 278 and a convex right end 280 and a jog 281 in its left portion. Jog 281 elevates the right portion of hold open arm 276 to a plane parallel to and above the plane of the left portion as shown in FIG. 1 and FIGS. 3A, 3B, 4A, 4B, 4C and 5.

Figure 4A:
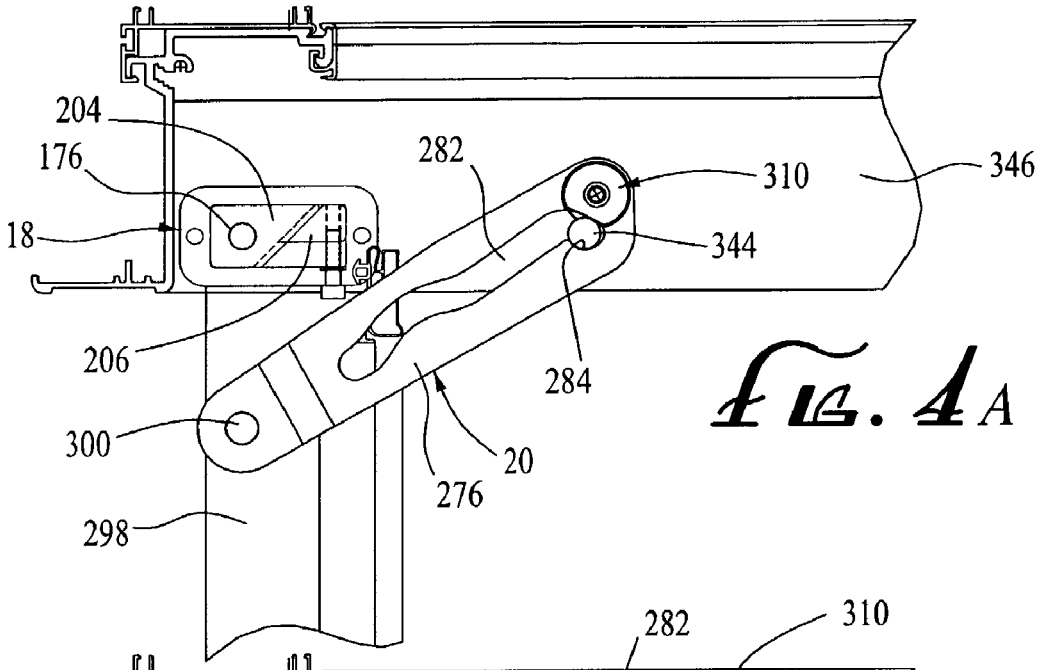
FIGS. 4A, 4B and 4C show the activated semi-automated door holding open and release mechanism with the door in various positions as well as the door leveling assembly.
Figure 4B:
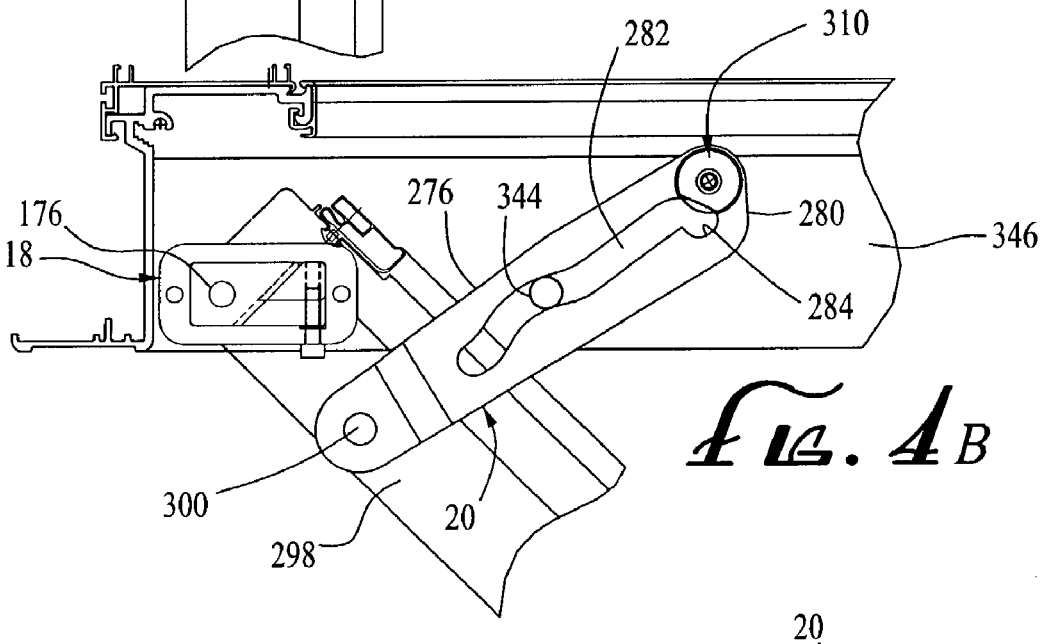
Figure 4C:
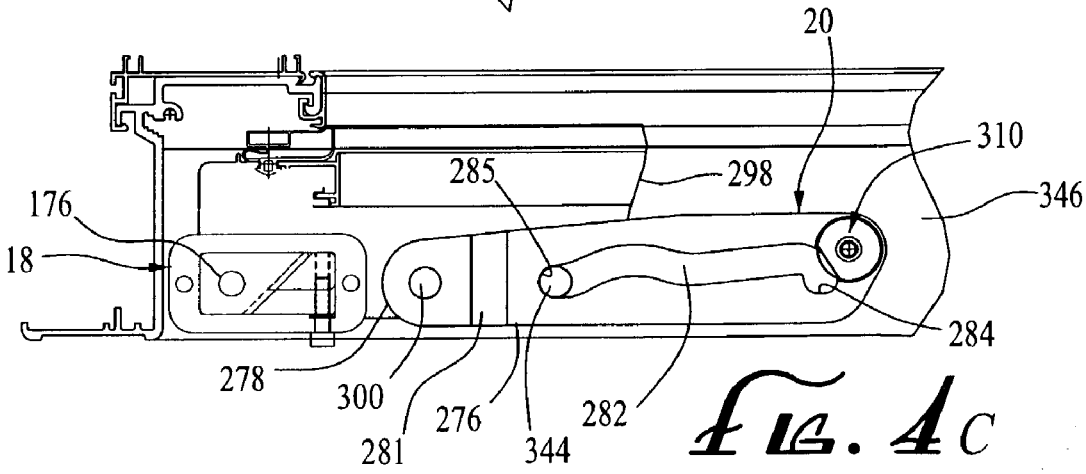

Door hold open arm 276 has a longitudinal slot 282 in its center portion. Slot 282 has its right end 277 formed in a semi-circular cavity 284 downwardly oriented and has a curved left end 285 as shown in FIGS. 4A, 4B, and 4C. The edge 279 of right end 277 is formed in a slight curve terminating in semi-circular cavity 284. Slot 282 has a top 286 formed with a convexity 288 at its left portion and a concavity 290 formed at its bottom 292 opposite to the convexity 288. However, the slot 282 can be formed with a straight top and bottom so long as the semi-circular cavity 284 is maintained in the orientation shown in the above identified figures.

Door hold open arm 276 is pivotally mounted at its end portion that is nearest to the hinge side of door 298 and on the top surface 294 of the top 296 of door 298 at its hinge side by a pivot 300 inserted through a circular opening 302 located at the end portion of door hold open arm 276 and nearest to the hinge side of door 298 and secured in a threaded bore (not shown) in the top surface 294 of the top 296 of door 298 by retaining ring 306 as shown in FIG. 1 and FIGS. 4A, 4B, and 4C and FIG. 5.

Pivot 300 has a circular groove 301 in its center portion 303 which is located just above the top surface of door hold open arm 276 and receives retaining ring 306 which is snapped into position in groove 301. Retaining ring 306 has a circumference greater than the circumference of circular opening 302 and of threaded bore (not shown). The lower portion (not shown) of pivot 300 has a larger circumference than the upper portion of pivot 300 and is hexagonally formed and threaded which allows lower portion of pivot 300 to be firmly threaded into threaded bore (not shown) in top surface 294 of top 296 of door 298. Although the foregoing embodiment of the pivot 300 is preferred, any suitable alternative means for securing pivot 300 may be used. For example, hexagonal lower portion 305 may not be hexagonal or larger than center portion 303 and opening 302 need not be circular.

The upper right end portion of hold open arm 276 has a circular opening 308. Door holding assembly 310 is received in opening 308 and is made up of a flat round washer cover 312, preferably made of brass or aluminum or other suitable material, having a central opening 313 and a downwardly projecting flange 314 around its circumference except for a slot or open or portion 316, a washer 318 preferably made of urethane or other suitable resilient material, and a rivet 320 preferably made of steel.

Washer 318 is placed in position in circular recess 322 cut out from the upper right end portion of hold open arm 276 and around circular opening 308. The right half 324 of recess 322 is formed with inner shoulder 326 and outer shoulder 328 but the left half 330 of recess 322 is formed with only an inner shoulder 332, as shown in FIG. 3B. Slot 310 permits an exposed portion of washer 318.

The difference in the size of the right half 324 and left half 328 is needed to allow a portion of washer 318 to be exposed due to the slot or open portion 316 of the flange 314 of washer cover 312 when washer cover 312 is placed in position over washer 318. Washer cover 312 and washer 318 are maintained in position by steel rivet 320 inserted in circular opening 313 of washer cover 312 and in circular opening 308 and coining the bottom portion of steel rivet 320 to hold washer cover 312 and washer 318 firmly in position.

The top 334 of the head 336 of rivet 320 is in alignment with the top surface 338 of washer cover 312 by providing head 336 with an inwardly tapered body portion (not shown) which is congruent with the outwardly tapered portion 339 of the top 342 of washer cover 312. A 5/16th inch slotted head screw 344 is located within the slot 282 of hold open arm 276 and screwed into the bottom surface of the top of frame 346 with threads at its lower half.

Figure 5:
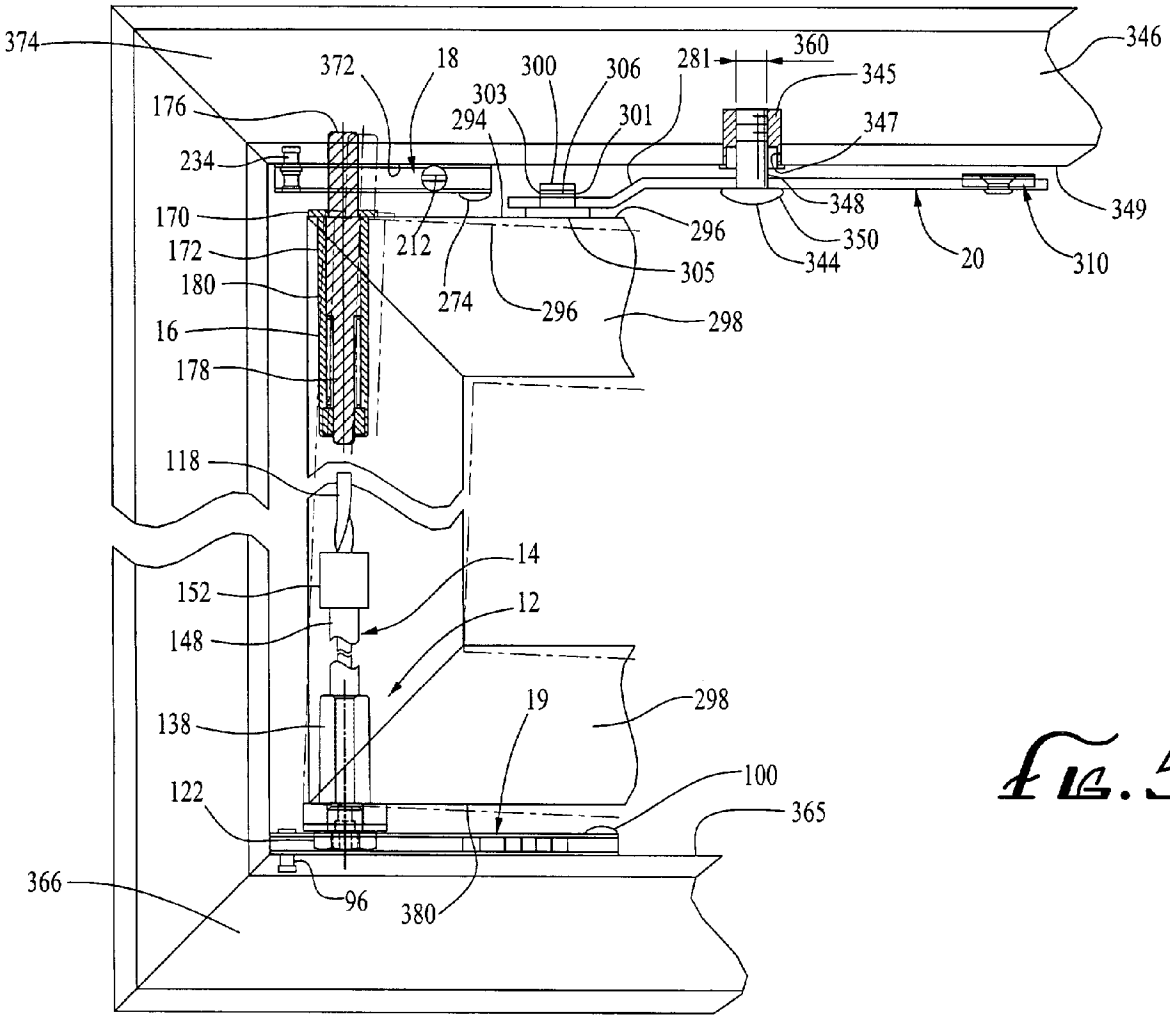
FIG. 5 is a front elevational view showing the torqued door hinge assembly including the hinge and torque rod.

Screw 344 has a circular smooth upper portion of its shank 348 for contacting the exposed portion of washer 318. A preferred application of screw 344 is to thread it into a flared and threaded nut 345 installed in a circular recess 347 in bottom surface 349 of the top of frame 346, as shown in FIGS. 1 and 5. The nut 345 has an outer flange 350 as shown in FIGS. 1 and 5, and an inner flange not shown which is formed by an installation tool and maintains the nut 345 in position.

Jog 281 formed at the left portion of hold open arm 276 redirects the left portion of hold open arm 276 downwards to allow attachment of it to pivot 300.

The location of cavity 284 is critical and its position is determined by a phantom straight line 293 drawn from center 354 of circular opening 308 and of rivet 320 through point 287 to intersect a phantom straight line drawn from the center 356 of circular opening 302 of hold open arm 276 through the center 352 of cavity 284 and terminating tangentially at the circumference 358 of washer 318 as shown in FIG. 3A, their intersection forming an angle which can vary from 40 to 50 degrees, 45 degrees being optimum and preferable and which faces washer 318 as shown in FIG. 3A.

Point 287 is formed at the junction of the right end of bottom 292 of slot 282 with the left end of inner surface 283 of cavity 284 opposite to the exposed portion of washer 318 as shown in FIG. 3A.

The position of the exposed portion of washer 318 is determined by phantom straight line 293 drawn from the center 354 of circular opening 308 and of rivet 320 through point 287, bisecting the exposed portion of washer 318 and the open portion or slot 316 of flange 314 of washer cover 312.

Diameter 360 of shank 348 of screw 344 is in a preferred ratio of 0.45 to 1.00 with the diameter 362 of washer 318. Thus, a preferred actual size is shank diameter 360 being 280/1000 of an inch and washer diameter 362 being 625/1000 of an inch. These sizes may be varied plus or minus 2% so long as the preferred ratio is maintained.

The distance from the center of the exposed portion of washer 318 to point 287 formed at the upper end of inner surface 283 of cavity 284 opposite to the exposed portion of washer 318 is preferably 220/1000 of an inch but may vary plus or minus 5% without adversely affecting the operation of the semi-automated door held open and release mechanism 20. The distance from point 287 to the center of the top and bottom edges of slot or opening 316 of flange 314 along phantom straight line 293 is preferably 300/1000 of an inch but may vary plus or minus 5% without adversely affecting the operation of the semi-automated door held open and release mechanism 20.

The diameter 364 of cavity 284 is preferably 280/1000 of an inch but may vary plus or minus 5% without adversely affecting the operation of the door held open and release mechanism 20.

The diameter of flange 314 is preferably 670/1000 of an inch and can vary plus or minus 2%. The width of slot or open portion 316 of flange 314 is preferably 76/1000 of an inch and can vary plus or minus 2%. The diameter of washer 318 is preferably 625/1000 of an inch and can vary plus or minus 2%. The exposed portion of washer 318 can be compressed or deformed to reduce the diameter of washer 318 at the point of compression by 60/1000 of an inch or about 10% of the original or undeformed diameter of washer 318. The center of the exposed portion of washer 318 overhangs cavity 284 to the extent of 80/1000 of an inch measured along phantom straight line 283 beginning from the top and bottom edges of the slot or open portion 316 of flange 314.

Assembly of the Invention

The invention is assembled on door 298 and frame 346 in the following way.

Torque housing assembly 19 is installed at the top surface 365 of the bottom 366 of the hinge side of frame 346 by inserting floating locking pin 96 into a circular locking hole not shown having slots at either end (not shown) formed in top surface 365 of the left side of frame 346 and by securing torque housing 19 with installation screw 100 screwed in threaded hole (not shown) in top surface 365 of bottom 366. The slots in circular locking hole (not shown) allow for movement of torque housing 19 to the left for a left hand door, or to the right for a right hand door.

Door leveling assembly 18 is installed in bottom surface 372 of top 374 of the hinge side of frame 346 by placing the door leveling assembly 18 in position with the floating locking pin 234 over a circular opening (not shown) having locking slots at either end (not shown) formed in bottom surface 372 of top 374 of frame 346 and then inserting floating locking pin 234 into circular opening (not shown) and securing door leveling assembly 18 with installation screw 274 screwed in a threaded hole (not shown) in bottom surface 372 of the top 374 of the hinge side of frame 346.

The bottom surface 380 of door 298 has square opening 382 which leads to internal square bore 384 extending upwards to square opening 383 in top surface 294 of top 296 of door 298 on the hinge side of door 298.

Torque rod assembly 14 is installed inside bore 384 by inserting the torque rod assembly 14 in square opening 382 and bore 384, oriented so that the top end 132 of torque rod 118 goes into bore 384 first along with the smaller tapered portion of torque rod bushing 138. The insertion of torque rod assembly 14 continues inside bore 384 until the increasing outer circumference of torque rod bushing 138 at the top surface of flange 147 of base 146 of torque rod bushing 138 forms a press fit with square opening 382. The press fit holds torque rod assembly 14 firmly in position.

Hinge pin assembly 16 is installed in door 298 on the hinge side of door 298 by inserting it in square opening 383 in the top surface 294 of the top 296 of door 298 and in bore 384, oriented so that the reduced circumference of elongated inner shank portion 178 of hinge pin 176 goes into bore 384 first along with the smaller tapered portion of hinge pin housing 160. The insertion of hinge pin assembly 16 continues inside bore 384 until the increasing outer circumference of the taper of hinge pin housing 160 at the circular flange 170 of hinge pin housing 160 forms a press fit with square opening 383. The press fit holds hinge pin assembly 16 firmly in position so that about 75% of hinge pin 176 remains inside hinge pin housing 160 and 25% outside.

After the press fit is accomplished, circular flange 170 rests on top surface 294 of the top 296 of door 298.

Before any assembly of components is installed in door 298, pivot 300 of door held open and release mechanism 20 is initially installed on top surface 294 of top 296 of door 298 by screwing the threaded and hexagonally formed lower portion (not shown) of pivot 300 into threaded bore (not shown) of top 296 just far enough to leave room to install the left portion with a downward oriented jog 281 of hold open arm 276, using circular opening 302 on pivot 300 below groove 301 of pivot 300, so that hold open arm 276 rests on the top surface of hexagonal formed lower portion 305 of pivot 300. Threaded bore (not shown) is located a suitable distance in the opposite direction from the hinge side of door 298, preferably a distance of about 15% of the length of the top of a door.

Hold open arm 276 is then placed in a position over pivot 300 such that circular opening 302 permits insertion of hold open arm 276 over the top of pivot 300 to rest on the top surface of hexagonal formed lower portion 305 of pivot 300. Retaining ring 306 is then snapped into groove 301, thereby securing pivot 300 in position with hold open arm 276.

Frame 346 is conventionally installed in the opening of a cabinet or case (not shown). Door 298 is then installed in frame 346 by inserting the hexagonally shaped bottom portion of torque rod nut 122 into torque gear 30.

Hinge pin 176 is then depressed and aligned with door leveling assembly 18 by aligning hinge pin 176 with slide plate 204 and aligning the outer shank portion 182 of hinge pin 176 with slot 270 of bottom cover plate 264 and with circular opening 244 of slide plate 204. Hinge pin 176 is then released and due to it being spring loaded, outer shank portion 182 engages circular opening 244 of slide plate 204 and goes through slot 270 of top cover plate 262 as shown in FIG. 5 and is received in an opening in the bottom of frame 346 as shown in FIG. 1.

Door 298 is now completely installed.

Next, semi-automated door held open and release mechanism 20 is installed in frame 346 by opening door 298 to access longitudinal slot 282. Screw 344 is inserted into slot 282 and threaded into nut 345 installed in circular recess 347 in the bottom surface 372 of the top 374 of frame 346 so that the circular smooth upper portion of shank 348 of screw 344 remains exposed.

Operation of the Invention

Door 298 is torqued by inserting a torque tool 80, which can be a piece of square rod, a screwdriver, Allan wrench of suitable size, or any suitable tool having the capability of in the direction of door handle 390, depending on whether door 298 is a left opening door or right opening door. A minimum of three rotations is recommended to get proper door torquing so that door 298 may be pretorqued to keep door 298 in a closed position and to close door 298 when it is about 3 to 6 inches open.

As torque tool 80 turns torque cam 34, torque cam 34 turns around cam pivot pin 74, and torque cam 34 moves gear actuating lever 86, thereby engaging teeth 68 of torque gear 30. As torque gear turns one tooth at a time by gear actuating lever 86, pawl arm 50 locks torque gear 30 immediately after gear actuating lever 86 has rotated one tooth of teeth 68, automatically due to pawl arm 50 being spring loaded. Only one tooth of teeth 68 can be rotated at a time, which provides precise and accurate control of the torquing process.

When torque tool 80 is removed, gear actuating lever 86 returns to a relaxed position due to being preloaded by springs 44.

If adjustment of the door 298 is needed, door 298 may be adjusted to a level position in a left or right direction by turning adjustment screw 212 in the desired direction, resulting in lateral movement of hinge pin 176. This operation is easier to accomplish than prior art devices because it is carried out at the top of the door, which provides a more convenient access for the operator than prior art devices that are limited to access to the bottom of the door for leveling purposes.

Further, adjustment of the door 298 according to the present invention is accomplished without opening the door, which remains in closed position during the adjustment. In contrast, the prior art known to applicants requires opening of the door during the adjustment process as well as operating at the bottom of the door, making the adjustment process more difficult and more time consuming.

When door 298 is manually opened to 90 degrees and is desired to be held open at 90 degrees, the semi-automated door held open and release mechanism 20 is activated as follows.

The opening of door 298 causes the main torquing of door 298 due to the twisting of torque rod 118. The opening of door 298 causes turning of square torque rod block 152 which is firmly held in position inside internal square bore 384 of door 298. The square central bore 154 of torque rod block 152 keeps the portion of torque rod 118 inside torque rod block 152 firmly held in its original position inside torque rod block 152 while door 298 is opening.

Meanwhile, the portion of lower end 120 of torque rod 118 inserted into square bore 127 of torque rod nut 122 is maintained in position by engagement of lower portion 128 of torque rod nut 122 in torque gear 30. Since the top end and the bottom end of torque rod 118 are both fixed and maintained in position, the turning of door 298 twists the middle portion of torque rod 118, thereby producing the main torque on door 298.

Although lower portion 128 of torque nut 122 is preferably hexagonal in shape and the interior of torque gear 30 is preferably formed in a 12 point internal drive or recess to produce a positive engagement of these component parts to prevent torque nut 122 from turning independently from torque gear 30, various alternative forms are possible to achieve positive engagement. Lower portion 128 and the interior of torque gear 30 each could be square, triangular, or any shape or combination of shapes that would have the effect of producing positive engagement of them when assembled.

As door 298 is being opened, hold open arm 276 pivotally moves from its resting position with the door closed as shown in FIG. 4C, to a mid position as shown in FIG. 4B. The pivotal movement of hold open arm 276 relocates the relative position of screw 344 from the curved left end 285 of slot 282 to a mid position in slot 282 as shown in FIG. 4B. As door 298 is opened closer and closer to 90 degrees open, the resulting further pivotal movement of hold open arm 276 brings opening 291 of cavity 284 closer and closer to screw 344.

The actual size of opening 291 of cavity 284, $^{300}/_{1000}$ of an inch, is greater than the diameter $^{280}/_{1000}$ of an inch of the smooth upper shank 348 of screw 344 but is made slightly smaller, $^{220}/_{1000}$ of an inch due to the exposed portion of washer 318 opposite inner surface 283 of cavity 284 and bisected by phantom straight line 293 between point 287 and center 354 as shown in FIG. 3A. As door 298 moves toward a 90 degree open position, the extreme pivoting of hold open arm 276 causes curved edge 279 formed at right end 277 of slot 282 to engage the smooth upper shank 348 of screw 344, which then presses against the exposed portion of washer 318 and deforms it sufficiently, about $^{60}/_{1000}$ of an inch plus or minus 2% to increase the width of opening 291 to $^{280}/_{1000}$ of an inch, which allows screw 344 to pass through opening 291 as hold open arm 276 continues its pivoting and as door 298 arrives at a 90 degree open position.

At the 90 degree open position of door 298, hold open arm 276 has completed its pivoting and has brought the location of screw 344 past opening 291 and into engagement with the inner surface 283 of cavity 284 so that screw 344 is completely enclosed in cavity 284 as shown in FIG. 4A and is held in a resting position inside cavity 284.

While screw 344 rests, the exposed portion of washer 318 that was deformed by screw 344 to a deformation of 60/1000 of an inch changes to a deformation of 20/1000 of an inch thereby returning opening 291 to a smaller open width size while the exposed portion of washer 318 maintains contact with the smooth upper shaft 348 of screw 344, thus serving to help maintain engagement of smooth upper shaft 348 with the inner surface 283 of cavity 284 and the resting position of screw 344 as well as the extended position of hold open arm 276 as shown in FIG. 4A.

The material of which washer 318 is made must have sufficient resilience to allow deformation of the exposed portion of washer 318 to a deformation of 60/1000 of an inch which widens opening 291 sufficiently to pass screw 344 through opening 291 and then to allow its return from its deformed condition of 60/1000 of an inch to a deformed condition of 20/1000 of an inch and then to its original undeformed condition. It must also have enough resistance or strength to maintain its deformed condition of 20/1000 by engagement with the smooth upper shank 348 of screw 344 while screw 344 is in its resting position. A preferred material for washer 318 is a urethane plastic having a Durometer value hardness of 75D plus or minus 5D, a tensile strength of 62 Mpa(9,000 psi) plus or minus 5%, elasticity property of Mpa 32(4,650 psi) plus or minus 5%, a compression set using Method A(ASTM D395) measured at 9.3 Mpa(1,350 psi) of 10% plus or minus 5%, and resilience property using Rebound(Bashore) of 45% plus or minus 5%.

The engagement of the smooth upper shank 348 of screw 344 against the inner surface of cavity 284 is mainly due to the torque pressure produced from the opening of door 298. The exposed portion of washer 318 assists the engagement of the smooth upper shank 348 of screw 344 against the inner surface 283 of cavity 284 by preventing the existing torque on door 298 from allowing the smooth upper shank 348 of screw 344 to re-deform the exposed portion of washer 318 which would restore the actual width of opening 291 and release screw 344 from its resting position. Since the actual width of opening 291 has a diameter larger than the smooth upper shank 348 of screw 344, restoration of the actual width of opening 291 would release screw 344 from its resting position inside cavity 284 by allowing screw 344 to pass back through opening 291 on its way to its starting position inside slot 282 as door holding arm 276 pivots in returning to its closed position due to the existing torque on door 298 closing door 298.

Applicants estimate that about 90% of the holding of screw 344 in its resting position in cavity 284 comes from its engagement with the inner surface 283 of cavity 284 opposite the exposed portion of washer 318. In contrast, the exposed portion of washer 318 in its original undeformed condition contributes about 10% of the holding of screw 344 in its resting position.

So long as screw 344 remains in its resting position, door 298 is held open to 90 degrees. Conventional door holding open devices are limited to 87 degrees or less of door opening and holding. While screw 344 is in its resting position, screw 344 is subjected continually to about 2½ pounds of force, plus or minus ½ a pound, due to the torque created by opening door 298 using its handle to a 90 degree open position. The amount of torque on door 298 created by pre-torquing is so slight as to have no effect on the hold open process.

This force of 2½ pounds is insufficient to deform the exposed portion of washer 318 sufficiently to restore the original size of opening 291 and allow disengagement of screw 344 from the inner surface 283 of cavity 284 so that screw 344 may exit cavity 284.

Held open door 298 may be then closed by a person applying manual slight pressure of at least 5 pounds of force, plus or minus ½ a pound, inwardly on door handle 390 or anywhere inwardly on door 298, thereby activating the semi-automated operation of the hold open and release mechanism 20 to close door 298.

The inward pressure on door 298 produces inward movement of hold open arm 276 initially that causes inner surface 283 of cavity 284 to press against the smooth upper shank 348 of screw 344 which in turn presses against and deforms the exposed portion of washer 318 sufficiently to open the path through opening 291 to its original width and to release engagement of the smooth portion of screw 344 with the inner surface 283 of cavity 284 and allow screw 344 to pass back through opening 291. Since the release of screw 344 also releases door 298 immediately from its 90 degree held open position, the existing torque on door 298 immediately brings door 298 back to its closed position.

When screw 344 is released from cavity 284, hold open arm 276 begins to pivot back towards its original position and door 298 begins to close. The release of screw 344 allows unwinding of the twisted torqued portion of torque rod 118, which applies closing torque to door 298 that returns door 298 to a completely closed position.

For applications of the invention where an air tight seal of the door in its frame is required, a rubber or other elastomeric type gasket may be attached to the interior perimeter of door 298 to form an airtight seal when door 298 is closed as well as to other doors employing the invention.

Although the invention has been described in detail with reference to the accompanying drawings illustrating preferred embodiments of the invention, it is understood that numerous changes may be made in the details of construction and arrangement of parts without departing from the spirit and scope of the invention as hereinafter claimed.

We claim:

1. Apparatus for controlling movement of a hinged door having a square vertical bore on its hinge side with a square top opening and a square bottom opening and hinged on one side of a frame having a top, a bottom, and two sides all defining an opening closed by said hinged door and for torquing said hinged door when said hinged door is opened, comprising:

(1) a door hinge pin assembly inserted in said square top opening of said hinged door, comprising:

a hollow cylindrical housing member having a top end and a bottom end and with its top end formed with a circular flange and having a tapered outside circumference increasing in size toward said top end of said hollow cylindrical housing member and forming a press fit with said square top opening of said hinged door upon completion of insertion of said door hinge pin assembly, a hollow cylindrical plug member secured to said bottom end of said hollow cylindrical housing member, a hinge pin member inserted into said hollow cylindrical housing member and having its bottom end extending below the bottom of hollow cylindrical plug member and its top end extending into an opening in the bottom of said top of said frame;

a spring member surrounding said hinge pin member and having its bottom portion retained at the top of said hollow cylindrical plug member and its top portion abutting a portion of said hinge pin member, thereby controlling said hinge pin member and securing said hinge pin member in position;

(2) A door leveling assembly installed at the bottom surface of said top of said frame for leveling a hinged door up to ¼ inch out of square from the top of the door while said hinged door remains closed during said leveling, comprising:

a leveling housing having a spacer member with a top and bottom, said spacer member having a central opening and an opening at a portion of its right side wall and having a top cover member covering the top of said spacer member and a bottom cover member covering the bottom of said spacer member, said top cover member and said bottom cover member each having a congruent opening in alignment with said central opening and adapted for insertion of said hinge pin member, said spacer member being secured within said top and bottom cover members, a threaded adjustment screw member inserted into said opening at said portion of said right side wall of said spacer member, a slide plate member and an adjustment plate member disposed within said central opening and having their inner sides slidably interlocked, said slide plate member having a circular opening in its central portion formed to receive said hinge pin member, said circular opening being congruent with said congruent openings of said top cover member and said bottom cover member, and said adjustment plate member having a threaded bore in its right portion for receiving said threaded adjustment screw member whose rotation clockwise for a door hinged on its right side moves said adjustment plate member towards the front of said spacer member causing said slide plate to move horizontally to the right, and whose rotation counterclockwise moves said adjustment plate member towards the back of said spacer member causing said slide plate to move horizontally to the left, thereby causing corresponding movement of said hinge pin and for a door hinged on its left side, rotation of said adjustment screw member counterclockwise moves adjustment plate towards the front of said spacer member which causes said slide plate to move horizontally to the right and clockwise rotation of said adjustment screw member causes said adjustment plate member to move towards the back of said spacer member which causes said slide plate to move horizontally to the left, thereby providing leveling of a door hinged on its right side and leveling of a door hinged on its left side, thereby causing corresponding movement of said hinge pin, said door leveling assembly being securely mounted on the bottom surface of the top of said structure at the hinge side of the structure, whereby appropriate rotation of said threaded adjustment screw member levels an out of square hinged door in the structure by movement of said hinge pin member;

(3) a torque mechanism having a torque housing assembly and a torque rod assembly, said torque housing assembly comprising:

a housing mounted on the top surface of said bottom of the said structure at the hinge side of said door, a gear member mounted inside said housing and located in vertical alignment with said square bottom opening, said gear member having a central recess and formed with rotatable teeth, a spring controlled pawl member pivotally mounted in said housing and having its inner end engaging said teeth of said gear member to prevent reverse rotation of said teeth; and said torque rod assembly comprising:

a flexible rod member with an upper end and a lower end and washer member, said intersection of said phantom straight lines inserted through said square bottom opening and into said square vertical bore of said hinged door and extending upwardly in said square vertical bore of said hinged door, a torque nut member having its lower end fixedly engaged in said central recess of said gear member and having a central bore with a square upper portion and a cylindrical lower portion, said lower end of said flexible rod member being coined into said cylindrical lower portion of said torque nut member, a torque washer member inserted on said flexible rod member and seated on the top of said torque nut member, a torque bushing member inserted on said flexible rod member and seated on top of said torque washer, said torque bushing member having a circular flange at its base and a tapered outside circumference increasing in size toward said circular flange which together forms a press fit at said square bottom opening, a torque tubing member inserted on said flexible rod member and seated on the top of said torque bushing member, thereby creating a bearing surface on the top of said torque bushing member, and a torque rod block member having a square central bore and inserted on said flexible rod member with its the bottom of said torque rod block member seated on the top of said torque tubing member, said flexible rod member being twisted at its top end, thereby maintaining each of said torque block member, said torque tubing member, said torque bushing member, said torque washer member, and said torque nut member in stationary position, whereby opening said hinged door puts said hinged door under torque;

(4) a semi-automated mechanism installed on said top of said frame for holding said hinged door in a 90 degree open position while said hinged door is under torque and for immediately releasing said hinged door, comprising:

a door holding arm member having a longitudinal slot in its center and pivotally mounted at the top of said hinged door at the hinge side of said hinged door through an opening at the end portion of said door holding arm member located nearest to the hinge side of said hinged door, said door holding arm member having a circular opening at its other end, a circular recess formed in said door holding arm member around said circular opening, said circular recess having a right half with an inner shoulder and an outer shoulder and having a left half with an inner shoulder, a resilient washer member seated on said circular recess and having an exposed portion of its circumference, a cavity formed at the outer end of said longitudinal slot with its position with respect to said resilient washer member determined by intersection of a phantom straight line drawn from the center of said circular opening through a point formed at the junction of the right end of the bottom of said longitudinal slot with the left end of the inner surface of said cavity that is opposite to said exposed portion of said resilient washer member with a phantom straight line drawn from said center of said opening of said door holding arm member through the center of said cavity and terminating tangentially at the circumference of said resilient washer member, the intersection of said phantom straight lines forming an angle facing said resilient washer member, said angle varying from 40 to 50 degrees, a washer cover member having a central opening and a downwardly projecting flange member around its circumference with an opening in said flange revealing said exposed portion of said resilient washer member, the top of said washer cover member covering the top of said resilient washer member and said flange covering the sides of said resilient washer member, said opening and said exposed portion being bisected by said phantom straight line drawn from the center of said circular opening through said point, and said exposed portion extending over a portion of said cavity, a securing member for securing said resilient washer member in said recesses and said washer cover member on said resilient washer member, a bolt member located within said longitudinal slot and of the structure, said bolt member having a smooth upper shank, whereby, as said hinged door is being opened to a 90 degree held open position, said torque mechanism places said hinged door under torque and at the 90 degree position of said hinged door, said bolt member is located and kept in a resting position inside said cavity by said torque on said hinged door which maintains said bolt member against the inner edge of said cavity and by said shank abutting the exposed portion of said resilient washer member, thereby holding said hinged door in a 90 degree open position, whereby pushing inwardly on said hinged door releases said bolt member from said cavity and the torque on said hinged door closes said hinged door.

2. Apparatus for controlling movement of a hinged door as claimed in claim 1 in which said hinge pin member has a middle body portion, an outer shank portion extending above said circular flange and having a circumference smaller than the circumference of said middle body portion, and an inner shank portion having a circumference smaller than the circumference of said outer shank.

3. Apparatus for controlling movement of a hinged door as claimed in claim 1 in which said inner sides slidably interlocked of said slide plate member and of said adjustment plate member form an angled interface.

4. Apparatus for controlling movement of a hinged door as claimed in claim 1 in which said inner sides slidably interlocked of said slide plate member and of said adjustment plate member form an angled interface having an angle of 45 degrees.

5. Apparatus for controlling movement of a hinged door as claimed in claim 1 in which said angle formed by said intersection of said phantom lines is 45 degrees.

6. A hinge pin member formed in one rigid piece with areas of different circumferences and maintained in an up position by a spring member secured to a hollow cylindrical hinge pin housing to distribute load and reduce stress on said hollow cylindrical hinge pin housing when inserted in said hollow cylindrical hinge pin housing that has been installed in a hinged door having a square vertical bore on its hinge side with a square top opening and a square bottom opening and hinged on one side of a structure having a top, a bottom, and two sides all defining an opening closed by said hinged door comprising:

{{a}} an elongated middle portion which closely fits and bears against the middle inner wall portion of said hollow cylindrical hinge pin housing, an elongated upper shank portion with a circumference smaller than the circumference of said elongated middle portion and extending above said elongated middle portion, and closely fitting and bearing against a circular flange located at the top of said hollow cylindrical hinge pin housing, and {{a}} an elongated lower shank portion with a circumference smaller than the circumference of said elongated upper shank portion and closely fitting against the lower inner wall portion of said hollow cylindrical hinge pin housing, said elongated middle portion of said hinge pin being longer than said elongated upper shank portion, to thereby provide a large bearing surface against the inner wall portion of said hinge pin housing, whereby the load caused by the weight and movement of said hinged door on said hollow cylindrical hinge pin housing is distributed throughout the inner wall of said hollow cylindrical hinge pin housing, thereby reducing stress and increasing the life of said hollow cylindrical hinge pin housing.

7. A hinge pin member formed in one rigid piece and inserted into a hollow cylindrical hinge pin housing installed on a hinged door and maintained in an up position by a spring member secured to said hollow cylindrical hinge pin housing, said hinge pin member comprising:

{{a}} an elongated middle portion which closely fits and bears against the middle inner wall portion of said hollow cylindrical hinge pin housing, an elongated upper shank portion with a circumference smaller than the circumference of said elongated middle portion and extending above said middle body portion and closely fitting and bearing against the top portion of said hollow cylindrical hinge pin housing, and {{a}} an elongated lower shank portion with a circumference smaller than the circumference of said elongated upper shank portion and closely fitting and bearing against the lower inner wall portion of said hollow cylindrical hinge pin housing, said elongated middle portion of said hinge pin being longer than said elongated upper shank portion, to thereby provide a large bearing surface against the inner wall portion of said hinge pin housing, whereby the load caused by the weight and movement of said hinged door on said hollow cylindrical hinge pin housing is distributed throughout the inner wall of said hollow cylindrical pin housing, thereby reducing stress and increasing the life of said hollow cylindrical pin housing.

8. Apparatus for leveling an out of square hinged door having a square vertical bore on its hinge side with a square top opening and a square bottom opening and hinged on one side of a frame structure having a top, a bottom, and two sides all defining an opening closed by said hinged door, comprising:

(1) a leveling housing having a spacer member with a top and a bottom, said spacer member having a central opening and an opening at a portion of its right side wall, said leveling housing being secured to the bottom surface of the top of said frame at said hinge side of said frame;

(2) a threaded adjustment screw member accommodated in said opening at said portion of said right side wall;

(3) a top cover member covering the top of said spacer member and a bottom cover member covering the bottom of said spacer member, said top cover member and said bottom cover member each having a congruent opening in alignment with said central opening, said spacer member being secured between said top and bottom cover members;

(4) a hollow cylindrical hinge pin housing inserted into said square vertical bore and maintained in position by a press fit of its top circumference against said square top opening;

(5) a hollow cylindrical plug member secured to the bottom of said hollow cylindrical housing member, (6) a hinge pin member inserted into said hollow cylindrical housing member and having its bottom extending below the bottom of hollow cylindrical plug member and its top extending into an opening in the bottom of said top of said frame;

(7) a spring member surrounding said hinge pin member and having its bottom portion retained at the top of said hollow cylindrical plug member and its top portion abutting a portion of said hinge pin member, thereby maintaining said hinge pin member in an up position with said top portion inside said opening in the bottom of said top of said frame;

(8) a slide plate member and an adjustment plate member disposed within said central opening and having their inner sides slidably interlocked, said slide plate member having an circular opening in its central portion congruent with said openings of said top cover member and said bottom cover member and said top portion of said hinge pin member in its up position is inserted through all of said openings, said adjustment plate member having a threaded bore in its right portion for receiving said threaded adjustment screw member whose rotation clockwise moves said adjustment plate towards the front of said spacer member causing said slide plate to move horizontally to the right, and whose rotation counterclockwise moves said adjustment plate towards the back of said spacer member causing said slide plate to move horizontally to the left, whereby appropriate rotation of said threaded adjustment screw member levels an out of square hinged door in said frame through corresponding movement of said hinge pin member from said top of said frame while said hinged door is closed and without opening said hinged door.

9. Apparatus for leveling an out of square hinged door as claimed in claim 8 in which said inner sides slidably interlocked of said slide plate member and of said adjustment plate member form an angled interface.

10. Apparatus for leveling an out of square hinged door as claimed in claim 8 in which said inner sides slidably interlocked of said slide plate member and of said adjustment plate member form an angled interface having an angle of 45 degrees.

11. Apparatus for leveling an out of square hinged door as claimed in claim 8 in which said slide plate is larger in size than said adjustment plate.

12. Apparatus for holding open in a 90 degree open position and then releasing by manual activation of a torqued hinged door having a square vertical bore on its hinge side with a square top opening and a square bottom opening and hinged on one side of a structure having a top, a bottom, and two sides all defining an opening closed by said hinged door, comprising:

a door holding arm member having a longitudinal slot in its center and pivotally mounted at the top of said hinged door at the hinge side of said hinged door through an opening at the end portion of said door holding arm member located nearest to the hinge side of said hinged door, said door holding arm member having a circular opening at its other end, means installed in said square vertical bore at its bottom for applying torque on said door when said door is being opened, a circular recess formed in said door holding arm member around said circular opening, said circular recess having a right half with an inner shoulder and an outer shoulder and having a left half with an inner shoulder, a resilient washer member seated on said circular recess and having an exposed portion of its circumference, a cavity formed at the outer end of said longitudinal slot with its position with respect to said resilient washer member determined by intersection of a phantom straight line drawn from the center of said circular opening through a point formed at the junction of the right end of the bottom of said longitudinal slot with the left end of the inner surface of said cavity that is opposite to said exposed portion of said resilient washer member with a phantom straight line drawn from said center of said opening of said door holding arm member through the center of said cavity and terminating tangentially at the circumference of said resilient washer member, said intersection of said phantom straight lines forming an angle having an operating range of 40 to 50 degrees, a washer cover member having a central opening and formed with a downwardly projecting flange member around its circumference with an opening in said flange revealing said exposed portion of said resilient washer member, the top of said washer cover member covering the top of said resilient washer member and said flange covering the sides of said resilient washer member, said opening and said exposed portion being bisected by said phantom straight line drawn from the center of said circular opening through said point, said exposed portion extending over a portion of said cavity, means for securing said washer member in said recesses and said washer cover member on said washer member, a bolt member located within said longitudinal slot and secured in the bottom surface of the top of the structure, said bolt member having a smooth upper shank, whereby, as said hinged door is being opened to a 90 degree held open position, said torque means puts torque on said hinged door and at the 90 degree position of said hinged door, said bolt member is located and kept in a resting position inside said cavity by said torque on said hinged door which maintains said bolt member against the inner edge of said cavity and by said shank abutting the exposed portion of said resilient washer member, thereby holding said hinged door in a 90 degree open position, whereby pushing inwardly on said hinged door releases said bolt member from said cavity and said torque on said hinged door closes said hinged door.

13. Apparatus for holding open in a 90 degree open position and then releasing by manual activation a torqued hinged door as claimed in claim 12 in which said resilient washer member is made of a urethane material which allows deformation of the said exposed portion of said resilient washer member and restoration of said exposed portion from said deformation to its original condition.

14. Apparatus for distributing the load and reducing stress caused by the weight and movement of a hinged door on a hollow hinge pin housing, comprising:

elongated upper means disposed in said hollow hinge pin housing and adapted to closely fit and bear against the entire top portion of the inner wall of said hollow hinge pin housing, elongated middle means disposed in said hollow hinge pin housing and adapted to closely fit and bear against the middle portion of the inner wall of said hollow hinge pin housing, and elongated lower means disposed in said hollow hinge pin housing and having a circumference smaller than the circumference of said elongated middle means and adapted to closely fit against the entire lower portion of the inner wall of said hollow hinge pin housing, said elongated upper means and said elongated middle means and said elongated lower means all formed together in a single rigid piece, said elongated middle means being longer than said elongated upper means to thereby provide a large bearing surface against the inner wall portion of said hinge pin housing, thereby distributing said load and reducing stress caused by said weight and said movement of said hinged door on said hinge pin housing.

15. Apparatus for controlling movement of a hinged door, comprising:

door leveling means for leveling a hinged door out of level by leveling said hinged door from its top while said hinged door remains closed during said leveling.

16. Apparatus for pre-torqueing a hinged door having a vertical bore on its hinged side with a square top opening and a square bottom opening and hinged on one side of a frame and having a torque mechanism installed in said bore which is equipped with a flexible torque rod secured at its bottom end to a toothed torque gear installed in a cam system mounted at the bottom of said frame and secured at its top end inside said bore, comprising:

means directly engaging said cam system and adapted to cause said cam system to rotate said toothed torque gear in a counterclockwise direction for a door hinged on the left side of said frame and in a clockwise direction for a door hinged on the right side of said frame, means to limit rotation to one tooth of a said toothed torque gear at a time, means to lock said toothed torque gear in position after each rotation of said toothed torque gear, whereby, said hinged door is pre-torqued to a predetermined extent.

17. Apparatus for controlling movement of a hinged door having a square vertical bore on its hinge side with a square top opening and a square bottom opening and hinged on one side of a frame having a top, a bottom, and two sides all defining an opening closed by said hinged door and for torquing said hinged door when said hinged door is opened, comprising:

torque means for pre-torqueing said hinged door by rotation of only one tooth of a torque gear at a time and for torquing said hinged door, means to torque a flexible torque rod secured at its top end inside said square vertical bore of said hinged door and connected at its bottom end to a toothed torque gear mounted in a cam system installed at the bottom of said frame, means to directly engage said cam system to cause said cam system to rotate one tooth of said toothed torque gear at a time to a predetermined extent to produce a pre-torque condition of said hinged door, means for leveling an out of level hinged door from the top of said door while said door remains closed during said leveling, means to torque said hinged door while being opened, means to hold said hinged door open to 90 degrees, means to remove torque on said hinged door and to release said hinged door held open at 90 degrees, and means permitting said pre-torque condition of said hinged door to close said hinged door.

* * * * *